US005197398A

United States Patent [19]

Levy et al.

[11] Patent Number: 5,197,398

[45] Date of Patent: Mar. 30, 1993

[54] SEPARATION OF PYRITE FROM COAL IN A FLUIDIZED BED

[75] Inventors: Edward K. Levy, Bethlehem; D'Agostini Mark, Macungie, both of Pa.; Damir Latkovic, Zabreb, Yugoslavia; James W. Parkinson, Indiana, Pa.

[73] Assignee: Electric Power Research Institute, Palo Alto, Calif.

[21] Appl. No.: 686,182

[22] Filed: Apr. 16, 1991

[51] Int. Cl.[5] ..... F23D 1/00

[52] U.S. Cl. ..... 110/347; 110/218; 110/220; 110/232; 209/20; 209/474; 209/475

[58] Field of Search ..... 110/218, 220, 232, 347; 209/20, 40, 138, 474, 475, 466, 468

[56] References Cited

U.S. PATENT DOCUMENTS 2,303,367 12/1942 Kendall et al. ..... 209/446 X
3,539,001 11/1970 Binnik et al. ..... 209/475
3,774,759 11/1973 Weintraub et al. ..... 209/474
3,804,250 4/1974 Dankesreiter ..... 209/475
4,521,303 6/1985 Hicks et al. ..... 209/474 X

*Primary Examiner*—Favors Edward G.
*Attorney, Agent, or Firm*—Leonard Bloom

[57] ABSTRACT

Processes and arrangements that provide for the separation of pyrite from coal in a fluidized bed. The processes provide for more efficient and complete stratification of the bed materials in a vertical direction, so that the very top layer of the fluidized ved is coal having a reduced pyrite content. The process includes feeding the coal to be cleaned on top of a layer of magnetite. The process also includes fluidizing the bed until bed-bubbling separation occurs in the absence of steady-state conditions. The cleaned top layer of coal having a reduced pyrite content is then separated from the refuse coal in the bottom of the bed.

27 Claims, 9 Drawing Sheets

SEPARATION OF PYRITE FROM COAL IN A FLUIDIZED BED

BACKGROUND OF THE INVENTION

1. Field of the Invention

The present invention relates to processes and arrangements for the separation of pyrite from coal in fluidized beds and, in particular, gas or air-fluidized beds.

2. Description of the Background

The use of mechanical cleaning apparatuses and arrangements for reducing the ash content of coal is well-known. Coal cleaned by such apparatuses and arrangements has an increased heating value and decreased shipping costs. The coal product of such cleaning is also more uniform in quality.

Recently, additional emphasis has been placed on removing other impurities found in coal. Particular interest has centered on removing impurities, so as to lower and control the $SO_2$ quantity of the coal. To achieve this goal, mechanical cleaning apparatuses and arrangements have also been utilized for removing pyrite from the coal, thereby providing a "clean" coal having a reduced pyrite content. Some of these apparatuses and arrangements have proven so efficient that they are capable of reducing the sulfur content of coal to values that are so low that they permit the coal to be burned directly, without the necessity of furnishing additional apparatuses or processes for sulfur control.

The majority of mechanical cleaning devices presently in use utilize a "wet" cleaning process wherein crushed coal is first slurried with water. Then, by one of several possible methods, the high density pyrite and ash are separated from the product coal. The "clean" coal must then be de-watered prior to shipment or combustion.

Mechanical apparatuses that utilize air instead of water as the fluidizing material are also available. However, "dry" or pneumatic cleaning accounts for only a small fraction of installed coal cleaning capacity.

There are definite advantages to pneumatic cleaning over wet cleaning. Of all the processes, those that utilize pneumatic cleaning are the most acceptable from the standpoint of delivered BTU cost. Pneumatic cleaning does not contribute to water pollution, as do many wet cleaning techniques. In addition, air washed coal is much less susceptible to freezing during shipment and storage and it flows more freely in hoppers and bins. Finally, wet cleaning methods are not effective for the cleaning of extremely fine coal and pyrite particles, where surface phenomena interfere with the separation process.

It has further been disclosed to use air-fired fluidized bed principles in order to obtain the separation of denser particles from less dense particles.

In U.S. Pat. Letters No. 4,506,608 issued to Strohmeyer an unfired type of fluidized bed is used for separating denser/larger particles from less dense/smaller particles. In this device, under steady-state conditions, the denser/larger particles settle to the lower portions of the bed, where they are removed, and the less dense/smaller partices rise to the upper portion of the bed where they are removed. Unsaturated preheated air/gas is passed through the bed to fluidize it. Feedstock solid materials are added to the bed at an intermediate location thereof.

U.S. Pat. Letters No. 4,449,483 issued to Strohmeyer discloses a bed formed of a mixture of solid fuel and waste inert material particles that is fluidized by heated gas/air under steady-state conditions. When in the fluidized state, the lighter solid fuel particles separate from the heavier inert material particles. The inert materials are driven by the gas/air along the bed surface and solid fuel particles rise above the surface, each travelling to different removal points along the bed.

U.S. Pat. Letters No. 4,576,102 issued to Rasmussen, et al. disclose the removal of tramp material from gently sloped, skewed or serpentine fluidized bed vessels. A shallow bed is fluidized. Fluidizing air and gravity gently walk the tramp material toward a disposal point.

Finally, it has also been disclosed to use air fluidized bed principles to clean pyrite from coal while utilizing the principles of particle separation to improve stratification of the material in the bed. In U.S. Pat. No. 3,774,759 issued to Weintraub, et al., a method is disclosed for the separation of particulate solids of varying densities in a fluidized bed. In this method, it is disclosed to use an air-fluidized bed with magnetite as the bed material to separate pyrite from the coal under steady-state conditions. As taught therein, the coal and the magnetite are fed together into the bed vessel. Further, it is taught that when this process is made continuous, the fluidizing bed vessel should be equipped with an inclined fluidized bed that moves towards an end wall. The end wall, in turn, has adjustable orifices formed therein that permit the stratified heavy fraction and the intermixed lighter fraction to be removed separately.

While being useful for its purposes, the process and the arrangement disclosed in Weintraub nonetheless suffers from three primary drawbacks. The first of these drawbacks is that, under the steady-state conditions taught therein, stratification of the bed material is as not complete as would be hoped, thereby making removal and recovery of the desired coal particles difficult to satisfactorily achieve. The second of these drawbacks is that the maintenance of the steady-state conditions in the bed demand a high energy input and requires a large fluidized bed vessel. Finally, the third of these drawbacks is that the apparatus for and the method of removing the stratified layers from one another is not as efficient as one would desire.

Thus, it can be seen that there remains a need for processes and arrangements for separating pyrite from coal which more efficiently utilize the principle of separation of particles on the basis of size/density in order to improve the stratification of the material in the bed, so as to facilitate the removal of "clean" coal—that is to say, coal having a reduced pyrite content—from the bed. There further remains a need for such processes and arrangements that will result in sufficiently low capital and operating costs to be economically viable.

SUMMARY OF THE INVENTION

It is a primary object of the present invention to provide processes and arrangements that provide for more efficient separation of pyrite from coal in a fluidized bed, particularly, in conjunction with the principle of separation of particles on the basis of size/density in order to improve the stratification of pyrite and coal in a bed, so as to facilitate the removal of "clean" coal from the bed.

It is another primary object to improve present processes and arrangements, so as to more efficiently separate pyrite from coal in a fluidized bed and, in particular, for more efficiently utilizing the principle of separation of particles on the basis of size/density in order to improve the stratification of pyrite and coal in a fluidized bed. It is a further object of the present invention to provide processes and arrangements that provide the greatest levels of particle stratification in such a fluidized bed as possible.

It is a yet further object of the present invention to provide processes and arrangements that provide for the efficient removal of the desired layer of stratified particles from the fluidized bed.

Still yet another object of the present invention is to provide processes and arrangements for the separation of pyrite from coal which minimizes both the energy input necessary for operation and the capital costs of the equipment.

The processes and the arrangements of the present invention preferably employ the use of an air or gas fluidized bed to separate pyrite particles from coal. For most applications, and in the references, under normal conditions, a bed of particles fluidized with air or gas (heretofore referred to as air) is well-mixed under steady-state conditions with the result that the materials in the bed tend to be homogeneously distributed. However, the present invention utilizes the principle that, in a fluidized bed where particles of different densities and sizes exist, there is a tendency at near minimum fluidization conditions for the solids to stratify in the vertical direction according to density and, to a lesser extent, size. Thus, in the processes and arrangements of the present invention, the coal is fluidized in a bed of magnetite, so that the "clean" coal is made to stratify at the very top of the bed while the pyrite settles towards the bottom of the bed. As a result of this stratification, the layer of material at the top of the bed is "rich" in coal. This permits the top "coal rich" layer to be easily and efficiently removed from the bed vessel and the magnetite therein to be separated from the coal by magnetic means. In this fashion, a coal product may be obtained that has a reduced pyrite content.

According to the process of the present invention, the original positioning of the crushed coal to be cleaned relative to the magnetite in the bed has a very large effect on the tendency of the coal to stratify. Thus, in order to achieve the most effective separation of the coal from the pyrite, the coal is fed to the bed separately from the magnetite. In this regard, the magnetite is placed in the bed vessel first and the coal is then fed to the bed vessel, such that it is placed on top of the magnetite material thereby facilitating the coal's migration (stratification) to the top layer of the bed.

Further according to the process of the present invention, more efficient continuous cleaning of the pyrites from the coal results when the bed is fluidized to conditions wherein bed-bubbling separation occurs but before steady-state conditions are achieved. In addition to providing greater stratification of the materials in the bed being fluidized, such a process is operated for periods of time shorter than those required to reach steady-state conditions, thus reducing the energy input and reducing the size of the fluidized bed vessel which are necessary to effectuate cleaning. In accordance with the teachings of the present invention, a process is disclosed for the separation of pyrite from coal in a fluidized bed for providing coal having a reduced pyrite content. This process is of the type that has the steps of feeding magnetite and coal including pyrite into a bed vessel, whereby a bed of a layer of magnetite and coal including pyrite is formed. The bed of magnetite and coal including pyrite is fluidized. In this fashion, a fluidized bed of fluidized material is formed. In this bed, the pyrite is substantially separated from the coal and a coal having a reduced pyrite content is formed. The fluidized material is then removed from the fluidized bed, whereby coal having a reduced pyrite content is provided.

The improvement of this process is comprised of feeding the magnetite into the bed vessel before the coal including pyrite is fed into the bed vessel, whereby a bed of a layer of magnetite is formed, and feeding the coal including pyrite into the bed vessel and on the bed of the layer of magnetite, whereby a bed including a layer of coal including pyrite disposed on a layer of magnetite is formed. In this fashion, during the fluidizing of the bed of magnetite and coal including pyrite, wherein the pyrite is substantially separated from the coal, a fluidized bed is formed. In this fluidized bed, the solids are stratified in the vertical direction so that a top layer of coal substantially free of pyrite is formed at the very top thereof and with the pyrite being distributed vertically throughout the fluidized bed from the top to the bottom thereof. In this fashion, the fluidized bed has a top layer of fluidized material comprised substantially of coal having a reduced pyrite content and a relatively thin bottom layer of high pyritic sulfur concentration.

The improvement of this process may also be comprised of the bed of magnetite and coal including pyrite, being fluidized until bed-bubbling separation occurs in the absence of steady-state conditions. In this fashion, a fluidized bed is formed wherein the solids have a greater stratification in the vertical direction so that a layer of coal substantially free of pyrite is formed at the very top thereof and with the pyrite being distributed vertically throughout the fluidized bed from the top to the bottom thereof, whereby the fluidized bed has a top layer of fluidized material comprised substantially of coal having a reduced pyrite content is provided. The improvement of this process may also be comprised of pneumatically suction removing the top layer of fluidized material from the fluidized bed, whereby a product including coal having a reduced pyrite content is provided. Alternately, the coal product and coal rejects can be separated by allowing the rejects to flow through slots or holes in the bottom of the bed or along the side walls. Preferably, the bed vessel utilized in this process is an air or gas fluidized bed vessel.

In further accordance with the teachings of the present invention, an arrangement is disclosed for the separation of pyrite from coal including pyrite, in a fluidized bed. A fluidizing bed vessel receives therein a material to be fluidized and a fluidizing material. A magnetite feeder feeds magnetite into the bed vessel, whereby a bed of a layer of magnetite is formed. A coal feeder feeds coal including pyrite into the bed vessel and onto the layer of magnetite, whereby a bed of the material to be fluidized including a layer of coal including pyrite disposed on a layer of magnetite is formed. Means are provided for introducing the fluidizing material into the bed vessel having the bed of magnetite and the layer of coal including pyrite. In this fashion, the bed of magnetite and coal including pyrite is fluidized in the bed vessel, such that the pyrite is substantially separated from the coal. In addition, the solids in the fluidized bed are stratified in the vertical direction so that a top layer of coal substantially free of pyrite is formed at the very top thereof and with the pyrite being distributed vertically throughout the fluidized bed from the top to the bottom thereof, such that the fluidized bed has a top layer of fluidized material substantially comprised of coal having a reduced pyrite content. Finally, means are provided for separating the top and bottom layers of fluidized material from the fluidized bed, allowing coal having a reduced pyrite content to be obtained.

These and other objects and advantages of the present invention will be more clearly perceived and fully understood by reference to the following description, taken in conjunction with the accompanying drawings, set forth below.

DETAILED DESCRIPTION OF THE PREFERRED EMBODIMENT

Figure 1:
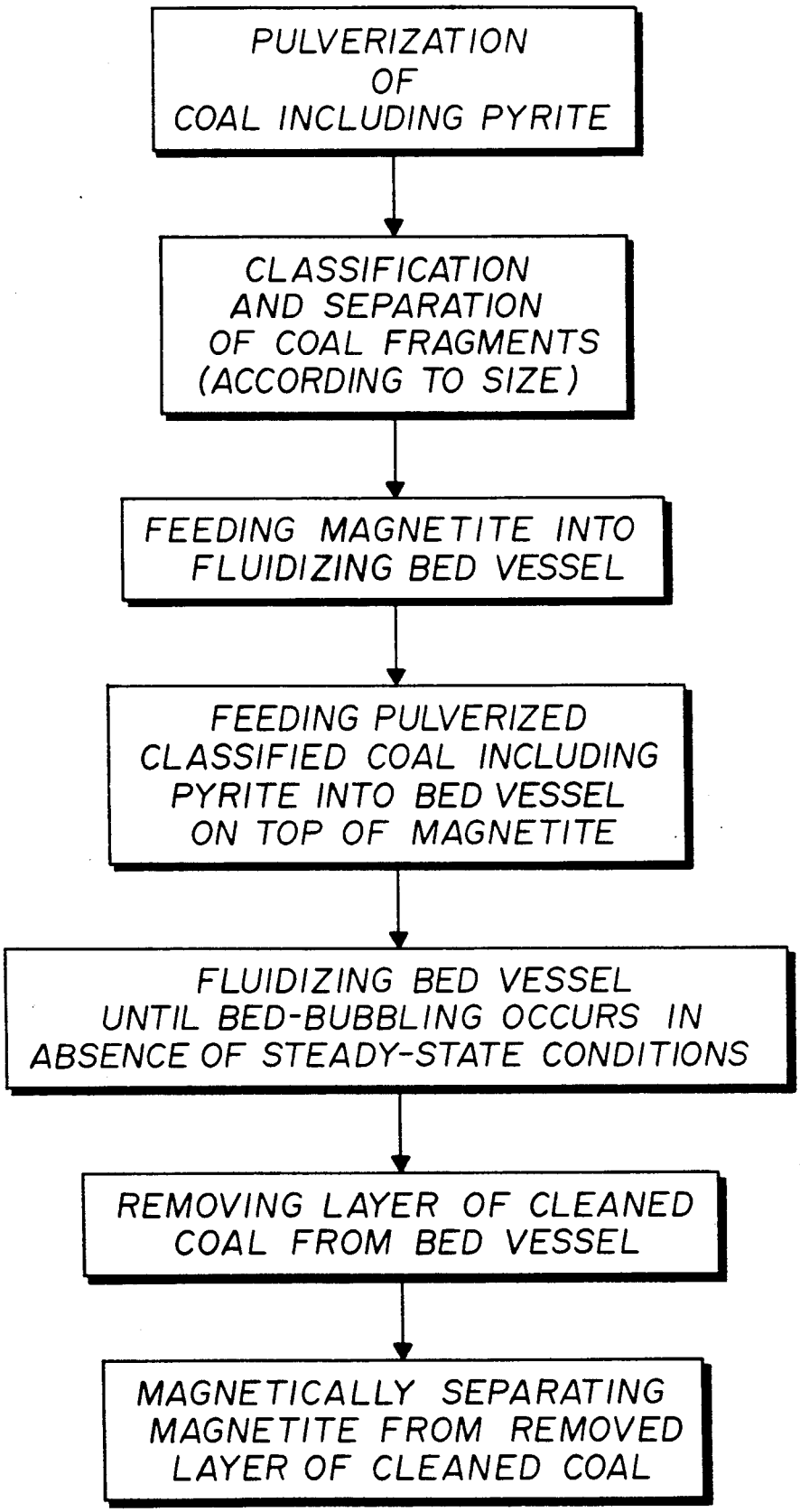
FIG. 1 is a flow chart illustrating the process of the present invention.

Referring in particular now to FIG. 1, according to the principles of the present invention, more efficient and effective stratification of the bed materials occurs when the coal including pyrite that is to be cleaned by fluidization is disposed on top of the magnetite. Additionally, more efficient and effective stratification of the bed materials occurs when the conditions in the fluidized bed vessel are such that bed-bubbling separation occurs in the absence of steady-state conditions. Finally, such efficient and effective stratification that is provided permits the efficient and effective removal of the desired material by simple means, such as a pneumatic suction device or gravity flow through a slot (or gap) that is formed in the bottom of the bed, both of which will be discussed at length below.

Figure 2:
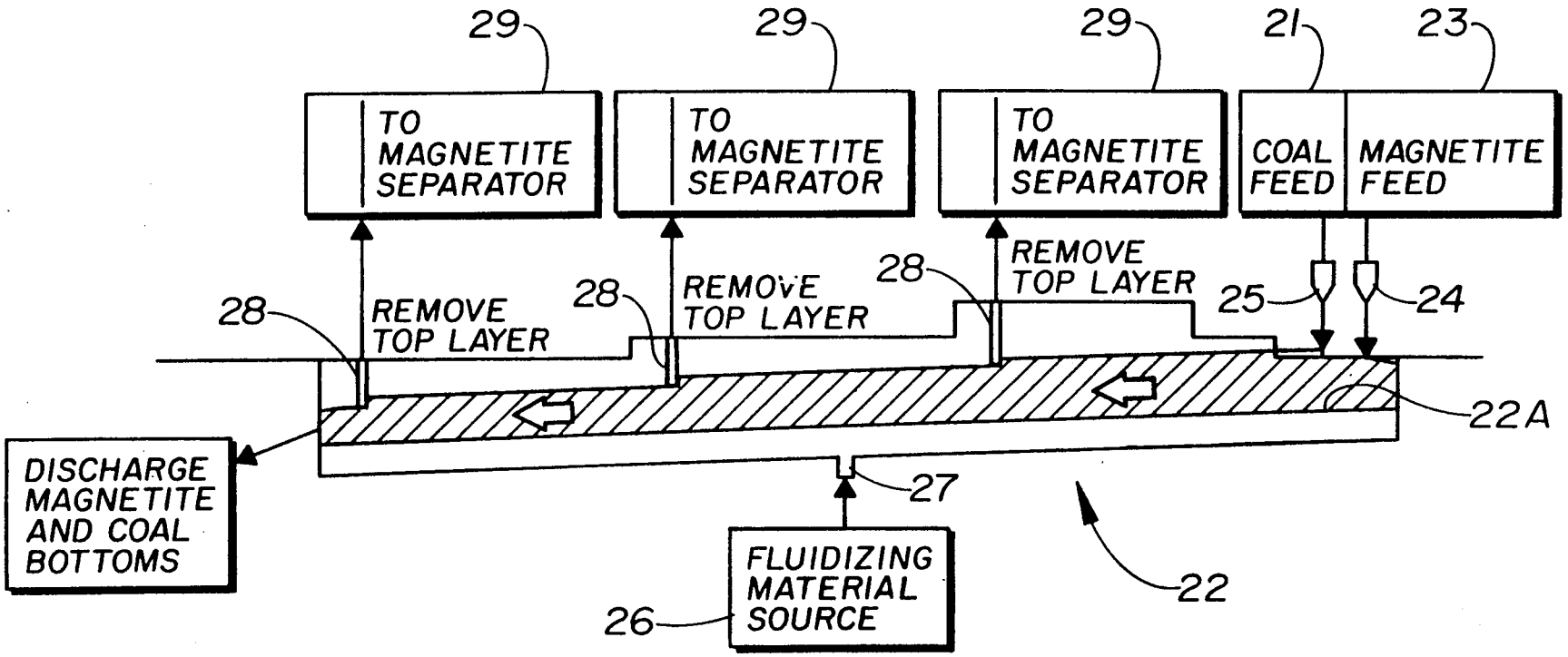
FIG. 2 is a side view, in cross-section of a fluidized bed vessel of the present invention for the continuous separation of pyrite from coal.

Referring now to FIG. 2, in order to achieve the principles of the present invention, as outlined above, the processes and the arrangements of the present invention utilize a conventional fluidized bed vessel 22 in which a bed of magnetite and coal including pyrite is fluidized. This fluidized bed vessel may, if desired, be either a liquid-fluidized bed vessel for effectuating wet cleaning or a gas-fluidized bed vessel for effectuating dry cleaning. Preferably, the bed vessel 22 is a gas-fluidized bed vessel.

As will be discussed at length below, in order to further achieve the principles of the present invention, the bed vessel 22 will be specially arranged. In a bed vessel 22 having a bed conveyor with a continuously flowing bed of material, to achieve the desired preparation of the bed of materials to be fluidized, so that the coal including pyrite is disposed on top of the magnetite, the coal feeder 21 is located downstream of the magnetite feeder 23. In order to achieve bed-bubbling conditions in the absence of steady-state conditions, the means for removing the top layer of fluidized bed material is located downstream of the coal feeder 21, at a suitable distance therefrom so that the desired bed-bubbling conditions are achieved. Finally, to provide for effective removal of the desired material by a simple means, in the embodiment illustrated in FIG. 2, the means provided for removing the top layer of fluidized material is in the form of a pneumatic suction device. This arrangement, and alternate techniques and structures that may be utilized will be discussed at length below.

Figure 3:
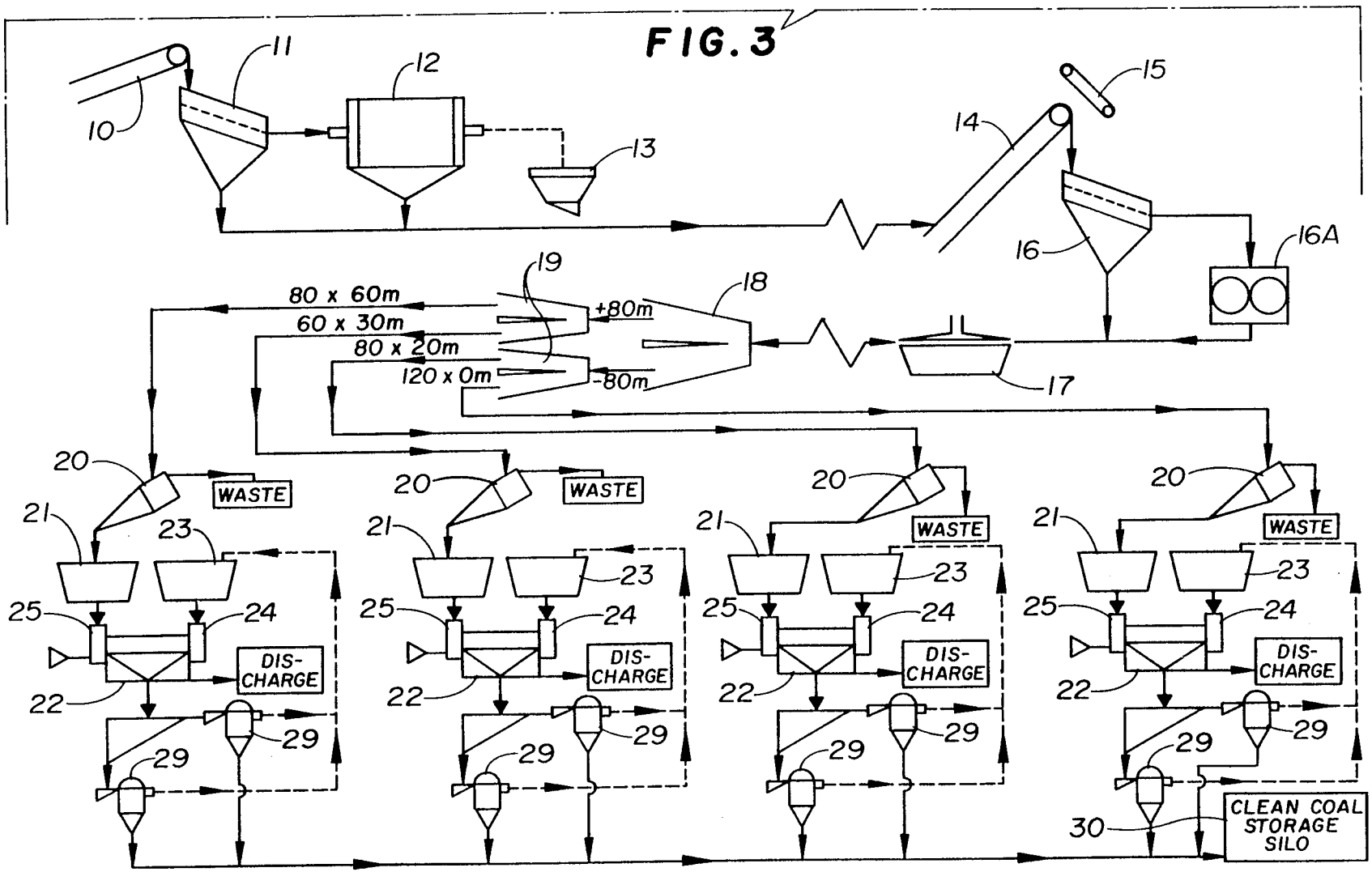
FIG. 3 is a process diagram for a "stand-alone" fluidized bed coal cleaning facility.
Figure 4:
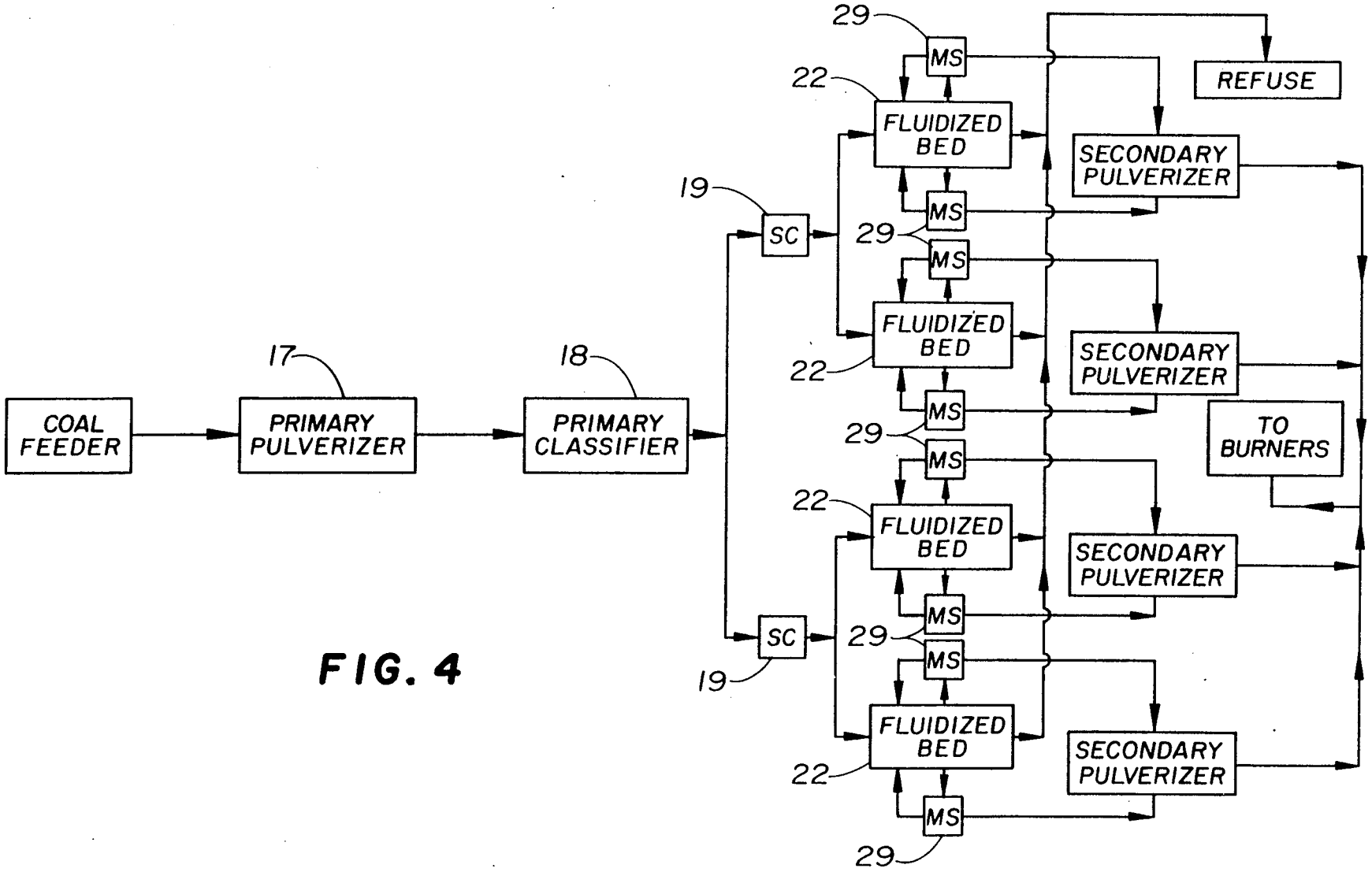
FIG. 4 is a schematic diagram for the fluidized bed coal cleaning facility of the present invention integrated into a coal-fired power plant.

With further reference now to FIGS. 3 and 4, in addition in FIGS. 1 and 2, the process and the arrangement of the present invention are now discussed. It is to be noted here that the arrangement of the present invention may be employed as either a "Stand-Alone" air-fluidized bed coal cleaning facility (FIG. 3) that is located at a source of raw, uncrushed coal, such as a mine, or it may be integrated into a coal-fired power plant (FIG. 4).

With particular reference now to FIG. 3, if raw, uncrushed and unclassified coal including pyrite is to be utilized, such as that which would be available if the arrangement were located at the coal source, such as a mine, then the raw coal is first transferred from the raw coal source by any suitable means, such as a conveyor 10 to a size classifier 11, such as a scalping screen. In the classifier 11, the coal is passed through a scalping screen, where it is classified and separated into two groups of coal fragments (fractions) based on the size thereof. One of the groups of coal fragments (fractions) are those pieces which are larger than 1½ inches in diameter. The other of the groups of coal fragments (fractions) are those pieces which are smaller than 1½ inches in diameter. The first group of coal fragments (those that are greater than 1½ inches in diameter) are then passed to a standard coal crusher 12 where they are crushed (coarse crushed). An example of such a standard coal crusher is a rotary breaker that crushes the coal into a size of less than 1½ inches in diameter.

The crushed coal is then remixed with the other group of fragments (that group which was already less than 1½ inches in diameter) and the refuse from the coal crusher is separated therefrom and passed to a rock bin 13. The refuse will be those fragments which, after crushing, remain greater than 1½ inches in diameter. Such fragments will substantially be pieces of rock, pyrite and other impurities.

The crushed coal is then carried by, i.e., a suitable conveyor line 14, pass a tramp iron magnet 15 which magnetically removes therefrom any tramp iron that may be therein.

The crushed coal is then deposited in a second standard coal size classifier 16 (such as a standard scalping screen), where it is again classified and separated on the basis of size. Based on such classification, the coal fragments that are ¼ inch or greater in size are removed from the main stream of coal fragments and are passed through a conventional coal crusher 16A where it is again crushed (coarse crushed) into fragments having a size of less than ¼ inch. The crushed coal fragments are then rejoined with those fragments of coal that already had a size of less than ¼ inch.

The rejoined crushed coal fragments, now having a size of ¼ inch or less, is a size that is normally found in coal that is supplied to coal-fired facilities.

With further particular reference now to FIG. 4, in addition to FIG. 3, the crushed coal having a size of ¼ inch or less is passed to a coal pulverizer 17. In the coal pulverizer 17 the coal fragments to be cleaned are pulverized into a fine coal having a size of, preferably, between 100–500 microns.

It is noted herein that we have found that, at least in batch processes, the process of the present invention works best over the limited range of particle sizes enumerated above. The upper limit of these particle sizes appears to be approximately 30 mesh (500 microns). This limitation on particle sizes is imposed by the inability to fluidize correspondingly coarse magnetite, having particle sizes larger than this size, which are in the bed. The lower limit of these particle sizes appears to be approximately 140 mesh (about 100 microns). This limitation on particle sizes is imposed by the difficulty of extremely fine coal to uniformly fluidize. Thus, employing a coal pulverizer 17 that grinds coarse feed to the top size limit while also limiting the production of ultrafine particles (those particles that are less than 50 microns in size), is preferred. It is further noted here that the pulverizer preferably grinds the coal on a dry basis. To be compatible with commercial scale operation of the method, it should also have a throughput of at least 10 tons per hour. Examples of pulverizers that meet these requirements include vertical spindle mill pulverizers, ball tube mill pulverizers and roller mill pulverizers.

The pulverized raw coal is then passed to a primary classifier 18. In the primary classifier 18, the pulverized coal is separated into one group of fragments (fractions) having a size of 80 microns or greater and a second group of fragments (fractions) having a size of 80 microns or less. Any suitable classifier, well known to those skilled in the art, may be utilized for this purpose.

It is noted that vertical spindle mill pulverizers are equipped with an integral particle classifier. Thus, if a vertical spindle mill pulverizer is utilized, then the primary particle classifier 18 may be omitted.

The separated and primary classified groups of coal fragments are then passed into respective, separate secondary classifiers 19. In these secondary classifiers 19, the groups of coal fragments (fractions) are further separated into additional various size fractions. This is done because the more narrow the range of coal particle sizes that are fed into the fluidized bed, the more uniform the fluidizing characteristics that are achieved therein will be. Thus, the process will, accordingly, be more efficient.

In a first of the secondary classifiers 19, the coal fragments having a size of 80 microns or greater are received and are separated into a first group of fragments (a first coal fraction) having a size of 80×60 microns, for example, and a second group of fragments (a second coal fraction) having a size of 60×30 m, for example. In the second of the secondary classifiers 19, the coal fragments (fractions) having a size of less than 80 microns, for example, are received and are separated into a third group of fragments (a third coal fraction) having a size of 80×120 m and a fourth group of fragments (a fourth coal fraction) having a size of 120×0 m. Each of the four groups of fragments (fractions) of coal including pyrite are then passed through respective cyclone filters 20 where initial filtration occurs and filtered waste matter is removed therefrom. The filtered coal fragments (fractions) then exit the respective cyclone filters 20, or other types of size separation devices, and are received in respective storage bins or silos 21. Each of the storage bins or silos 21 holds the filtered, pulverized coal until it is ready to be cleaned by having pyrite removed therefrom in the fluidized bed vessels 22, according to the process of the present invention.

The process and the arrangement of the present invention will now be discussed by referring to only one of the four groups of coal fragments (fractions) described above. In doing so, it is to be clearly understood however that each of the four groups of coal fragments (fractions) will be treated in the same manner with the same types of equipment as the arrangement to be described. With further particular reference now to FIG. 2, the process and the arrangement of the fluidized bed vessels 22 is now discussed. First, magnetite is fed from a respective magnetite storage bin or silo 23 into a fluidizing bed vessel 22 by a magnetite feeder 24. In this fashion, a bed of a layer of magnetite is formed therein. Preferably, this magnetite feeder 24 may be a conveyor or any other suitable apparatus well known to those skilled in the art. It is also preferred that the bed in the vessel 22 be an inclined fluidizing bed (distributor) 22A in order to achieve continuous cleaning in the bed vessel 22. Preferably, this inclination is a 1° inclination.

Next, the fragments (fractions) of coal including pyrite are fed by a standard coal feeder 25 into the fluidizing bed vessel 22, so that it is positioned on top of the bed of the layer of magnetite that is already located therein. In this fashion, the bed of material to be fluidized is formed that includes a layer of coal including pyrite that is disposed on top of a layer of magnetite. Like the magnetite feeder 24, the coal feeder 25 may be a conveyor or any other suitable apparatus well known to those skilled in the art.

In order to achieve the above layered feeding, in the event that the process of the invention is a continuous process, then the bed vessel 22 will, preferably, include a continuously moving bed of the conveyor variety, well-known to those skilled in the art. In such a case, the coal feeder 25 is located downstream of the magnetite feeder 24 in order to effectuate the layered composition of the bed material to be fluidized.

Preferably, the rate of the feeding of the magnetite and the rate of the feeding of the coal including pyrite is controlled, so that the mass feed ratio of coal including pyrite to magnetite is controlled. An example of such a preferred ratio of magnetite to coal is 1:1. Such control allows a ratio of coal to magnetite in the bed to be optimized. It also allows the thickness of the bed of magnetite and coal including pyrite to be controlled for optimizing the process. Such control may be effectuated by suitable means such as respective slide gateswell known to those skilled in the art that are mounted on the bottom of feeders 24 and 25.

Once the bed of magnetite and coal including pyrite is formed in the bed vessel 22, the bed may be fluidized by a fluidizing material that is introduced into the bed vessel 22 by a suitable means. Preferably, the bed vessel 22 is a gas-fluidizing bed vessel, including a fluidizing gas source 26 and a conduit 27 that is positioned between and is in communication with the gas source 26 and the bed vessel 22. In this fashion, the fluidizing gas from the gas source 26 is carried to and introduced into the bed vessel, such that the bed of material located therein is fluidized. It is further preferred that, it includes a means for controlling the velocity of the fluidizing gases based on the thickness of the bed. In this manner, the efficiency of the process may be further optimized. It is contemplated herein that the desired velocity will be 1½ to 3 times the minimum fluidization velocity needed to achieve fluidization of the bed of material being fluidized. Alternatively, the bed vessel 22 may be a liquid fluidizing bed vessel, including a fluidizing liquid. However, while being suitable, this is not preferred. The fluidizing of the material of the bed causes two events to occur. First, it results in the pyrite being substantially separated from the coal. Second, it forms a fluidized bed, wherein the solids are stratified in the vertical direction with the coal substantially free of pyrite located at the very top and with the pyrite (and magnetite) distributed vertically throughout the fluidized bed from the top to the bottom thereof. In this fashion, the fluidized bed has a to layer of fluidized material that is comprised substantially of magnetite and of coal having a reduced pyrite content.

As was noted above, with the coal initially disposed on the top of the fluidized bed, during fluidization the high density pyrite particles settle more rapidly in the downward direction and the coal particles with a lower density, flow downward at a slower rate.

For a brief period after the initiation of the process, the coal particles form a highly concentrated layer at the top of the bed. In this period, the liberated pyrite particles have nonetheless already separated from the coal and have drifted downward (sank) in the direction of the distributor. This stratification results in a highly concentrated layer of coal particles at the top of the bed which is deficient in pyrite. Below this top layer is a bottom layer having a high pyritic sulfur concentration. This advantageous situation occurs when bed-bubbling separation occurs but before steady-state conditions are achieved. We believe that this occurs because of different rates of settling of pyrite and coal particles. Accordingly, it is further preferred that fluidizing of the bed be carried out long enough until bed-bubbling separation occurs in the absence of (but not so long to permit the formation of) steady-state conditions.

In this respect, it is further noted that in addition to the more efficient stratification described above, fluidization for a length of time long enough to permit bed-bubbling to occur but not so long as to achieve steady-state conditions, greatly reduces the energy input and the size of the bed vessel that are required to obtain the desired cleaning and stratification.

The length of time that the bed of magnetite and coal including pyrite is fluidized is controlled based on the thickness of the bed and the superficial velocity of the fluidizing gases, in order to achieve the above-mentioned bed conditions. These controls may be respectively performed by any suitable means well known to those skilled in the art. However, in the former cases, it is preferred that if the process to be performed is a continuous process as is shown in the drawings, then this means may include a bed vessel 22 having a bed conveyor that provides a continuously flowing bed of particles 22A, the speed of the movement of which is selectively controllable. If the process to be performed is a batch process, then the means may include a simple shut off valve to control the flow of fluidizing material into the bed vessel and to remove therefrom any fluidizing material that may be therein.

Once the desired fluidization of the bed of coal and magnetite is completed, the top and bottom layers of fluidized material are separated by suitable means provided for that purpose. In this fashion, a product including coal having a reduced pyrite content is provided. It is preferred that this separator be comprised of pneumatically suctioning the top layer of fluidized material from the remainder of the bed by a pneumatic suction device 28 or by allowing the bottom layer of particles to flow out of the bed vessel under gravity through discharge holes or slots in the bottom of the bed.

In the embodiment illustrated in FIG. 4, in the event that pneumatic suctioning is employed, the removal conduit of this device 28 would, preferably contact the top layer, in effect scraping it from the remainder of the bed material and gathering it for removal through the tube by suction.

Figure 5:
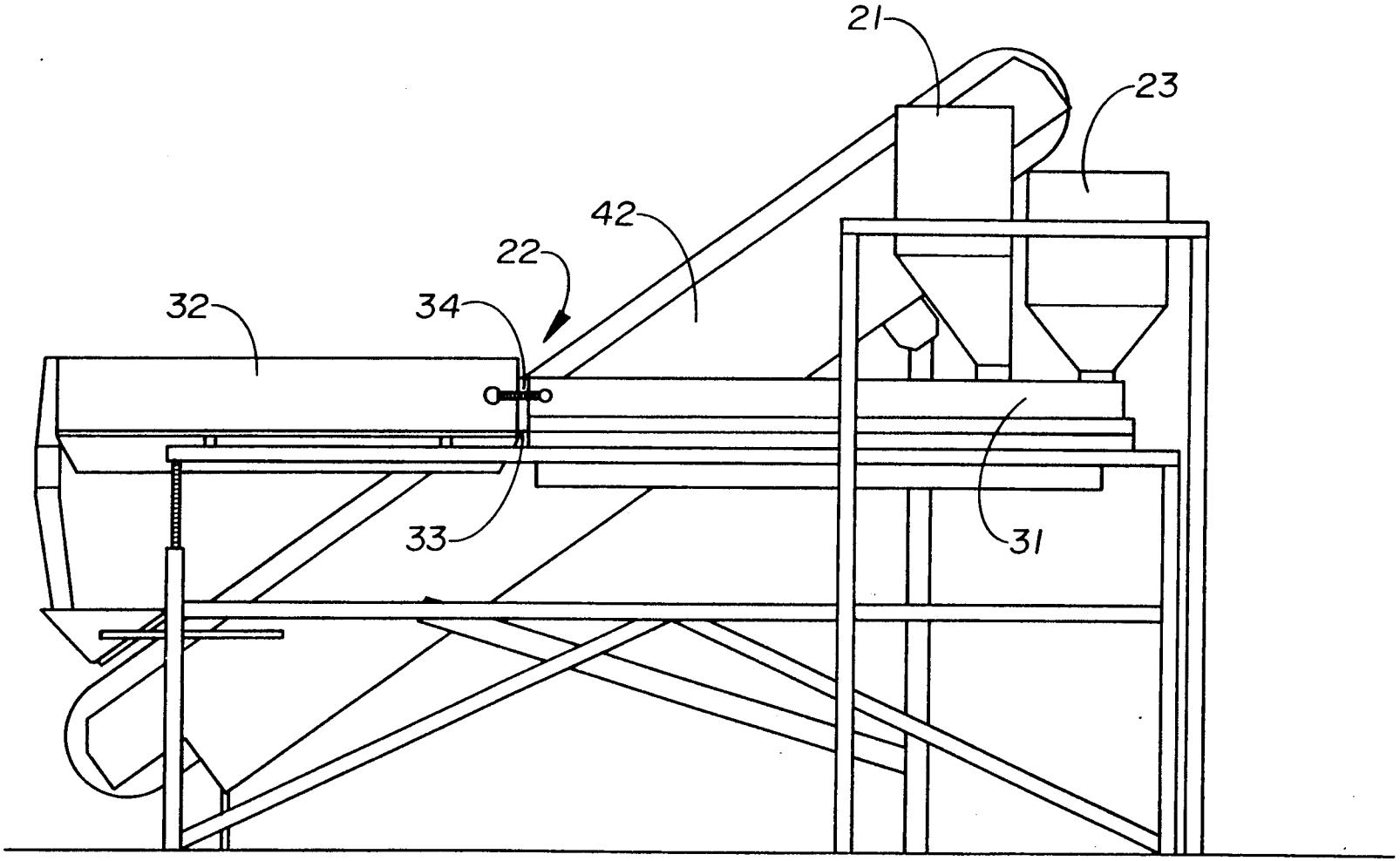
FIG. 5 is a side view of another fluidized bed vessel of the present invention for the continuous separation of pyrite from coal.

In another embodiment, illustrated in FIG. 5, the principle that the bottom layer of material having the high pyritic sulfur concentration (which is thin in comparison to the entire depth of the flowing bed) is formed is utilized to effectuate the desired separation. In this embodiment, the bed vessel 22 is formed in two sections or fluidized channels 31 and 32, one of which (the channel 31) has a length of 1.3 m and the other of which (the channel 32) has a length of 1 m. A gap of 33 is defined between these two channels 31 and 32. The bottom layer of material in the bed vessel 22 passes through the gap 33 by means of gravity as the bed material flows from the first of the channels (the channel 31) into the second of these channels (the channel 32). Finally, spacers of varying sizes are provided which when installed, vary the size of the gap 33, as desired In the present embodiment, these spacers are fabricated from plexiglass. However, the spacers may be fabricated from any suitable materials of construction. It should also be noted that, in the present embodiment, the two channels 31 and 32 of the bed vessel 22 are joined together by means of a connecting mechanism 34 that is located at each side of the channel walls. This connecting mechanism 34 includes two 1.5 mm steel plates, the ends of each of which are bolted to the adjoining channel walls. This connecting mechanism 34 further includes a 14 mm diameter screw that is welded at one of the plates, serving as a tightener. The plexiglass spacers are inserted between the ends of the channel walls to vary the size of the gap 33, as desired. The positioning of the spacers may then be tightened by means of the connecting mechanism 34.

Finally, once the top layer and bottom layers are separated and are removed from the bed vessel 22, they are passed by suitable means through at least one, and as seen in FIG. 3 preferably two separators 29. In the separators 29, the magnetite in the removed top layer is separated from the remainder of the top layer and removed either for recycling to the magnetite bin 23 for reuse or for placement in a refuse bin. In this fashion, what remains and what is obtained is a coal having a reduced pyrite content. Preferably, this separation occurs by magnetic separation performed in a magnetic separator, wherein a permanent magnet is encased in a rotating drum. However, it is to be expressly understood that any separator for receiving the top layer of fluidized material removed from the fluidized bed and for separating any magnetite in the removed top layer from the coal having the reduced pyrite content may be utilized.

The separated coal having a reduced pyrite content may then be either utilized directly or stored in a clean coal storage silo 30 until such use.

Figure 6:
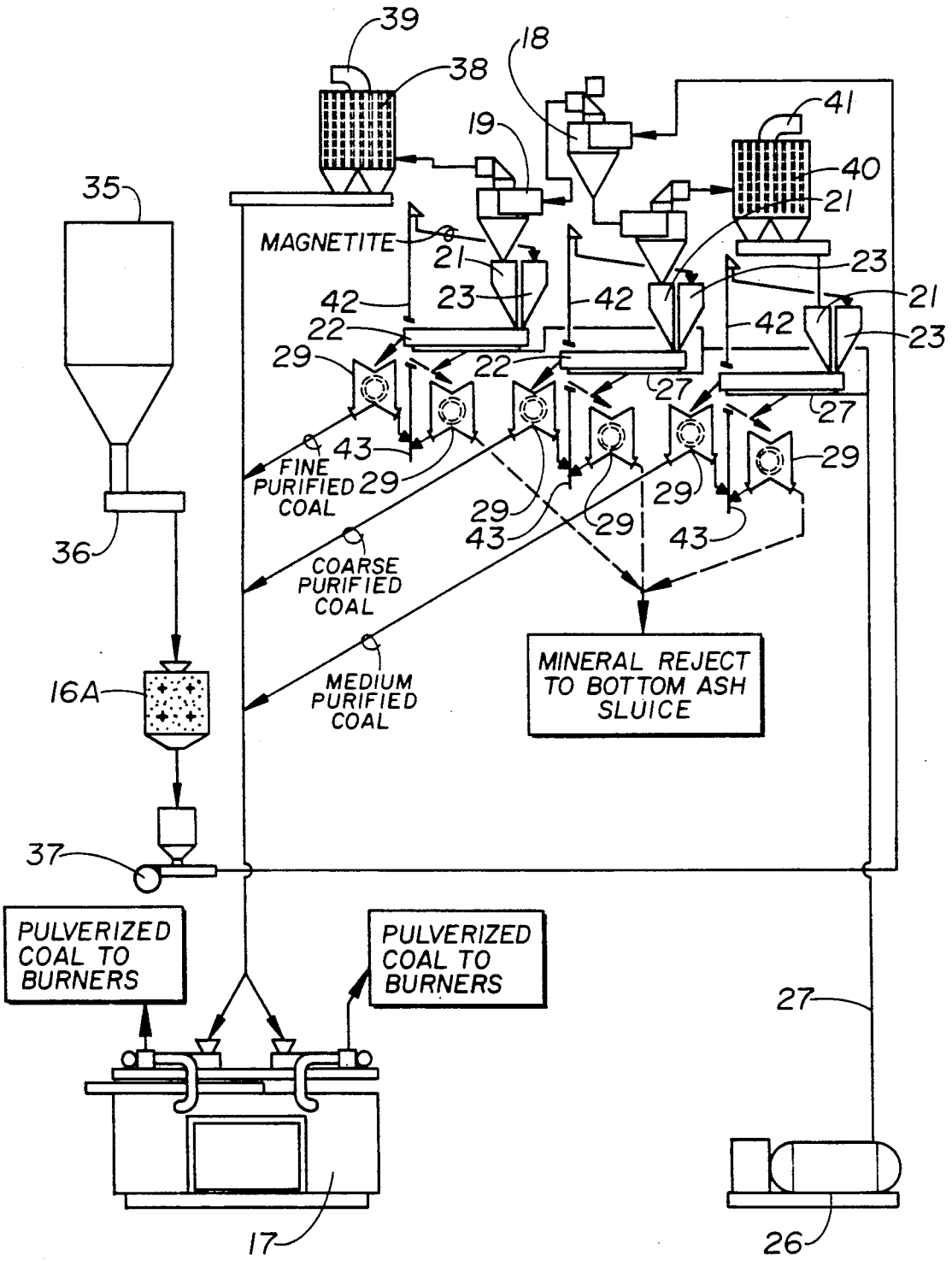
FIG. 6 is a process diagram of another arrangement for the fluidized cleaning of coal according to the principles of the present invention.

Referring now to FIG. 6, another arrangement is discussed wherein fluidizing bed vessels 22 are disposed ahead (upstream) of the coal pulverizer 17. In other words, crushed, but unpulverized coal is "cleaned" before it is pulverized into the size that is useful for use in the standard coal-fired burners that are normally found in a standard power plant. In the embodiment to be discussed, like numerals are utilized to refer to like parts.

Coal including pyrite is first fed from the existing coal bunker 35 by a feeder 36 into a standard roller mill (or coal crusher) 16A. In the crusher 16A, the coal is crushed (coarse crushed) into fragments having a size of 28 mesh×0. This crushed coal is then passed by a suitable means 37 well known to those skilled in the art, to a primary classifier 18, wherein the coarse-crushed coal is separated into two streams of coal fragments (fractions): (1) medium and coarse sized fragments (a medium and coarse fraction); and (2) fine fragments (a fines fraction). As disclosed herein, this classifier 18 is a standard air classifier, such as an aerodynamic particle size classifier well known to those skilled in the art. Examples of such classifiers 18 are rotating cyclone devices. The stream of fine coal fragments (the fines fraction) is then passed to a secondary classifier 19, wherein particulate fines (coal dust) are removed therefrom and are passed to a filter 38, such as the conventional bag house filter illustrated. A vent 39 ventilates this bag house filter 38 and coal dust recovered therefrom is then passed directly to the pulverizer 17. The remainder of the fine coal fragments in the secondary classifier 19 then exit therefrom, being received in the respective storage bins or silos 21 therefor.

Similarly, the stream of coarse and medium sized coal fragments (the medium and coarse coal fraction) is passed to a secondary classifier 19, wherein the smaller fragments therein, that is to say the medium sized coal fragments (the medium sized coal fraction), are separated into a separate stream from the larger, coarse fragments (the coarse coal fraction).

The stream of medium-sized coal fragments (the medium sized coal fraction) is then passed from the secondary classifier 19 into another filter 40, such as the conventional bag house illustrated, wherein particulate fines are removed therefrom. Once again, this bag house 40 is equipped with a vent 41 that ventilates this bag house 40. The medium-sized fragments (the medium sized coal fraction) of coal recovered from this bag house 40 is then passed to a respective bin or silo 21 therefor.

The stream of coarse coal fragments (the coarse coal fraction) is then passed from the secondary classifier 19 directly into the respective storage bins or silos 21 therefor.

Each of the bins or silos 21 holds the filtered, coarse-crushed coal until it is ready to be fed into a respective fluidizing bed vessel 22 where it is received on top of a bed of magnetite that has already been fed therein from the magnetite bin 23 by a conventional magnetite feeder, for being cleaned by having the pyrite removed therefrom in the fluidized bed vessels 22.

In order to achieve the layered feeding of the coal and magnetite that, as was discussed at length above, is essential to this invention, the bed vessels 22 illustrated in FIG. 6 are, like those discussed above, continuously moving beds of the conveyor variety, well-known to those skilled in the art. Also, as was discussed at length above, the coal feeder 25 is located downstream of the magnetite feeder 24 in order to effectuate the layered composition of the bed material to be fluidized.

As can be seen, the fluidizing material (the gas fluidizing agent) is preferably, a fluidizing gas, such as hot air, that is provided by a fluidizing gas source, such as an air compressor 26, and which is heated to its fluidizing temperature before it is delivered to the bed vessels 22 via conduits 27.

The fluidized and cleaned coal is then removed from the respective bed vessels 22 in the manner as was described above with reference to FIG. 5, so as to provide the desired separation of the layers of material in the fluidized bed. Magnetite recovered from the beds 22 may then be returned to the bins 23 therefor via magnetite elevators 42. The coal is then received in respective magnetic separators 29. In this fashion, the "cleaned" coal is then separated from any magnetite that may be mixed therewith. The magnetite that may have been separated from the coal in the separators 29 is then recovered and returned to the bins or silos 23 therefor via magnetite elevators 43. Other impurities (the mineral reject to bottom-ash sluice) that may have been separated from the coal in the separators 29 and carried away as waste by any suitable means to be discharged.

The three streams (fractions) of now "clean" coal: the stream (fraction) of purified fine coal fragments; the stream (fraction) of purified medium coal fragments; and the stream (fraction) of purified coarse coal fragments are then rejoined with one another and are introduced into the coal pulverizer 17 where they are pulverized into a size that is desired for use in the burners of a power plant facility. Preferably, this pulverizer 17 is a conventional ball-tube mill or a vertical spindle mill, both being well-known to those skilled in the art.

Figure 7:
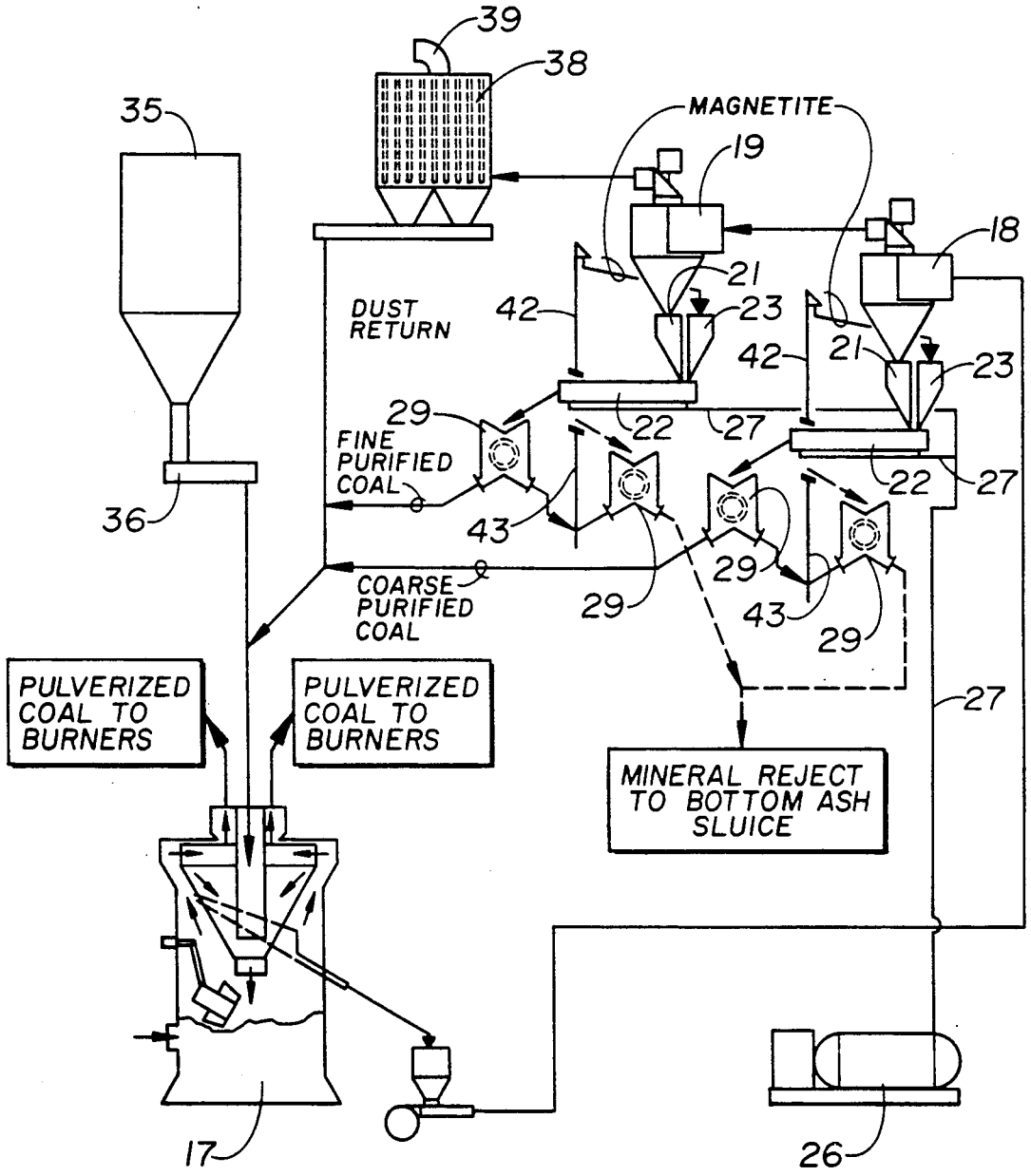
FIG. 7 is a process diagram of yet another arrangement for the fluidized cleaning of coal according to the principles of the present invention.

Referring now to FIG. 7, another arrangement is discussed wherein fluidizing bed vessels 22 are disposed being incorporated into the coal pulverizer 17. In other words, coal is pulverized into the size that is useful for use in the standard coal-fired burners that are normally found in a standard power plant both before and after it is "cleaned". In this fashion, the arrangement illustrated in FIG. 7, relates to that which has also been illustrated in FIG. 4. Once again, in the embodiment to be discussed, like numerals are utilized to refer to like parts.

Coal including pyrite is first fed from the existing coal bunker 35 by a feeder 36 into a standard pulverizer 17. An example of such a coal pulverizer is a bowl pulverizer, the structure and operation of which are well known to those skilled in the art. In the pulverizer 17, the coal is pulverized into fragments, and coal particles in the size range of 60 mesh×200 mesh are removed from the classifier cone internal to the pulverizer and passed by a suitable means 37, well known to those skilled in the art, to a primary classifier 18, wherein the coarse-crushed coal is separated into two streams (fraction) of coal fragments: (1) coarse sized fragments (a coarse fraction); and (2) fine fragments and dust particles (a fine fraction). As disclosed herein, this classifier 18 is a standard air classifier, well known to those skilled in the art. The stream of fine coal fragments is passed to a secondary classifier 19, wherein particulate dust is removed therefrom and are passed to a filter 38, such as the conventional bag house illustrated. A vent 39 ventilates this bag house 38 and coal dust recovered therefrom is then returned directly to the pulverizer 17. The remainder of the fine coal fragments in the secondary classifier 19 then exit therefrom being received in the respective storage bins or silos 21 therefor.

The stream of coarse sized coal fragments is then passed from the primary classifier 18 directly into the respective storage bins or silos 21 therefor.

Each of the bins or silos 21 holds the filtered, pulverized coal until it is ready to be fed into a respective fluidizing bed vessel 22 where it is received on top of a bed of magnetite that has already been fed therein from the magnetite bin 23 by a conventional magnetite feeder, for being cleaned by having the pyrite removed therefrom in the fluidized bed vessels 22.

In order to achieve the layered feeding of the coal and magnetite that, as was discussed at length above, is essential to this invention, the bed vessels 22 illustrated in FIG. 7 are, like the bed vessels discussed above relative to FIG. 6, continuously moving beds of the conveyor variety, well-known to those skilled in the art. Also, as was discussed at length above, the coal feeder 25 is located downstream of the magnetite feeder 24 in order to effectuate the layered composition of the bed material to be fluidized.

As can be seen, the fluidizing material (the gas fluidizing agent) is preferably, a fluidizing gas, such as hot air, that is provided by a fluidizing gas source, such as an air compressor 26, and which is heated to its fluidizing temperature before it is delivered to the bed vessels 22 via conduits 27.

The fluidized and cleaned coal is then removed from the respective bed vessels 22 in the manner as was described above with reference to FIG. 5, so as to provide the desired separation of the layers of material in the fluidized bed. Magnetite recovered from the beds 22 may then be returned to the bins 23 therefor via magnetite elevators 42. Coal is then received in respective magnetic separators 29. In this fashion, the "cleaned" coal is then separated from any magnetite that may be mixed therewith. The magnetite that may have been separated from the coal in the separators 29 is then recovered and returned to the bins or silos 23 therefor via magnetite elevators 43. Other impurities (the mineral reject to bottom-ash sluice) that may have been separated from the coal in the separators 29 and carried away as waste by any suitable means to be discharged.

The two streams (fractions) of now "clean" coal: the stream (fraction) of purified fine coal fragments; and the stream (fraction) of purified coarse coal fragments are then rejoined with one another and are recycled for reintroduction into the coal pulverizer 17 where they are again pulverized, this time into a size that is desired for use in the burners of a power plant facility.

The coal cleaning process of the present invention has been demonstrated in batch experiments and by computer simulation. The results of these demonstrations are shown below:

| | | Example One | | | | |
|---|---|---|---|---|---|---|
| | | % SULFUR REDUCTION | | | | |
| | | TOTAL SULFUR | PYRITIC SULFUR | SGS | EP | GEP |
| −30 −50 COAL | Experimental | 64 | ~85 | 2.2 | .65 | .30 |
| −70 −80 WASH | Theory | 51 | | 2.8 | .75 | .27 |
| MAGNETITE | | | | | | |
| Uo/Umfm = 2.1 | | | | | | |
| Uo = 7.98 cm/s | | | | | | |
| −50 00 COAL | Experimental | 66 | ~86 | 2.9 | .66 | .35 |
| −100 −200 | Theory | 46 | | 2.9 | 1.0 | .34 |
| MAGNETITE | | | | | | |
| Uo/Umfm = 2.3 | | | | | | |
| Uo = 5.3 cm/s | | | | | | |
| −80 −140 COAL | Experimental | 60 | ~82 | 2.4 | .65 | .27 |
| −120 −140 | Theory | 36 | | 3.0 | 0.7 | .23 |
| MAGNETITE | | | | | | |
| Uo/Umfm = 4 | | | | | | |
| Uo = 5.2 cm/s | | | | | | |

Key:
Uo - superficial gas velocity;
Umfm - minimum fluidization velocity;
cm/s - centimeters per second;
SGS - Specific Gravity of Separation;
EP - Ecart Probability;
GEP - Generalized Ecart probability.

Figure 8:
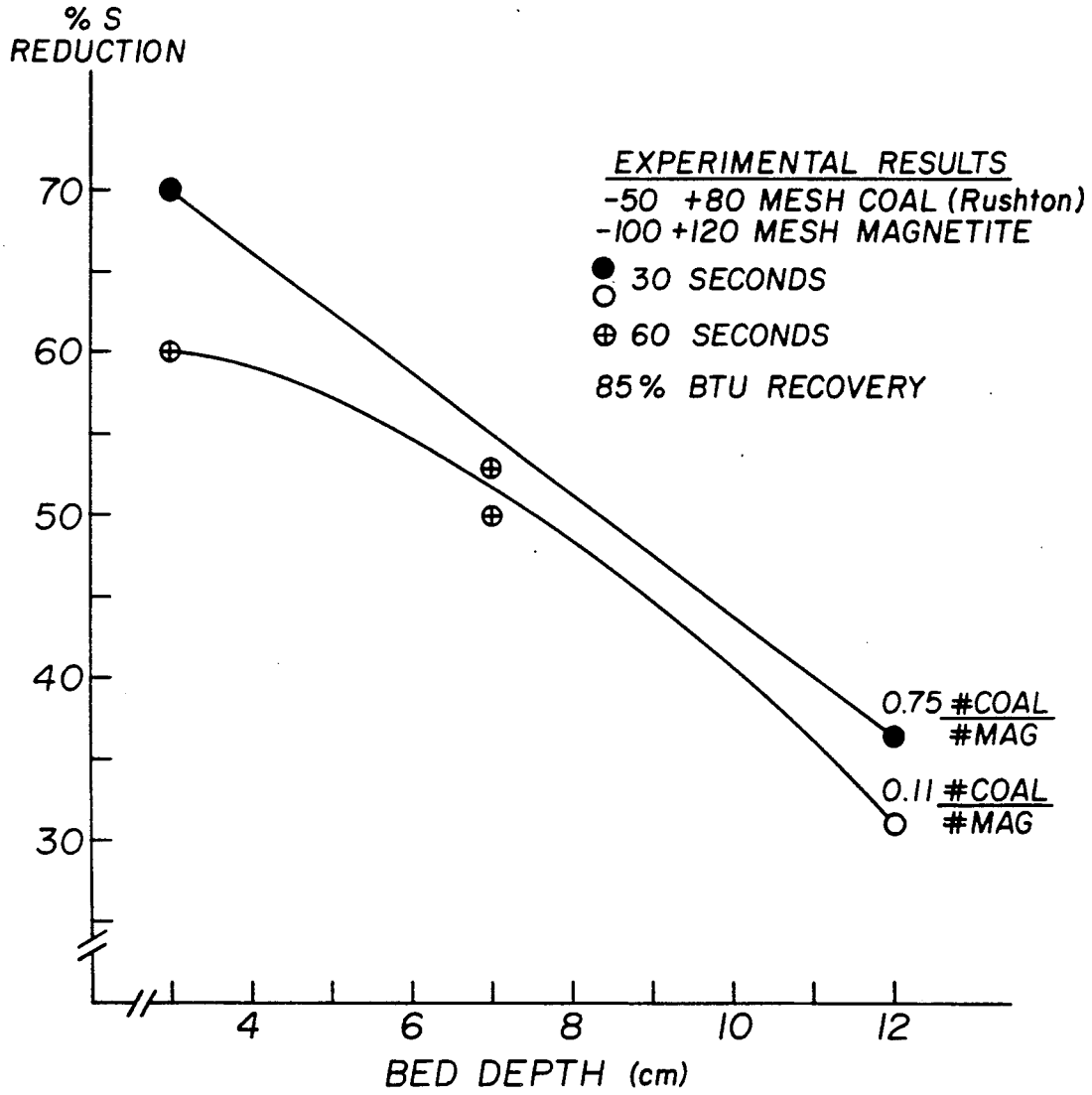
FIG. 8 is a graph illustrating the percentage of sulfur reduction that may be achieved in a fluidized bed according to the principles of the present invention as a function of the depth of the bed and of the feed ratio of coal to magnetite.
Figure 9:
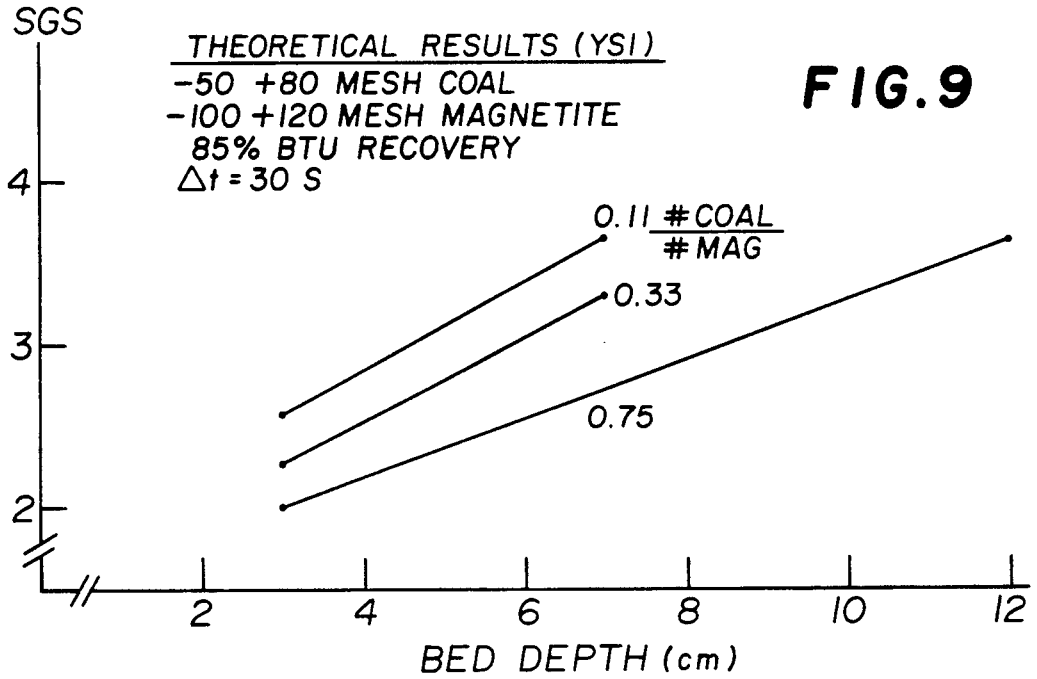
FIG. 9 is a graph illustrating the specific gravity of separation that may be achieved in a fluidized bed according to the principles of the present invention as a function of the dept of the bed and of the ratio of coal to magnetite that is fed to the bed.
Figure 10:
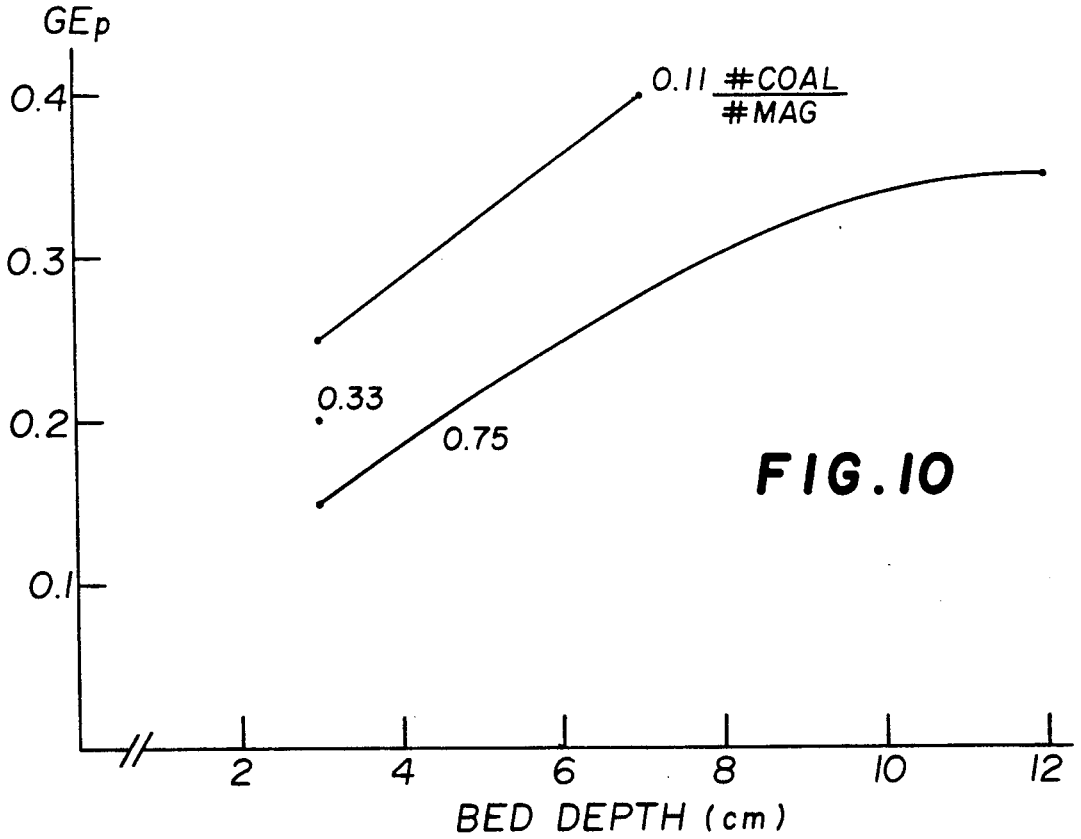
FIG. 10 is a graph illustrating the generalized Ecart probability that may be achieved in a fluidized bed according to the principles of the present invention as a function of the dept of the bed and of the ratio of coal to magnetite that is fed to the bed.

Other results are charted in FIGS. 8–10.

It is important to note that, in the process described above, the critical economic parameters are operating and maintenance labor requirements, the cost and power requirements of the pulverizer to crush the raw coal feed, the cost of electric power to run the facility, the process parameters relating to the magnetite to coal feed ratios and the number of distinct size classifications of crushed coal to be cleaned. In this regard, it is noted that the cleaning cost for a "stand-alone" facility is much higher than if the facility was instead integrated into a coal fired power plant. Comparisons against other fine coal cleaning techniques suggest that the air-fluidized bed process is more economical, primarily due to lower capital equipment costs and because other techniques are performed on a wet basis.

If desired, this process may be repeated one or more times, thereby achieving the effect of multiple stages of cleaning in one device.

It will be clearly understood by those skilled in the art that many modifications of this process and arrangement may be made. For example, a hybrid dry cleaning facility might employ the well-established air table cleaning facility for a coarse cleaning circuit, while reserving the fluidized bed process for the naturally occurring fines in the coal feed. Another possibility is a combination wet/dry facility where optimum results are obtained by "targeting" a particular size of feed to be cleaned by either hydrocyclones, jigs, fluidized beds or froth flotation cells.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In a process for the separation of pyrite from coal in a fluidized bed for providing coal having a reduced pyrite content, the process being of the type having the steps of feeding magnetite and coal including pyrite into a bed vessel, whereby a bed of a layer of magnetite and coal including pyrite is formed, fluidizing the bed of magnetite and coal including pyrite, whereby the pyrite is substantially separated from the coal and a coal having a reduced pyrite content is formed, and further whereby a fluidized bed of fluidized material is formed, wherein the solids are stratified in the vertical direction so that a top layer of coal substantially free of pyrite is formed at the very top thereof and with the pyrite being distributed vertically throughout the fluidized bed from the top to the bottom thereof, whereby the fluidized bed has a top layer of fluidized material comprises substantially of coal having a reduced pyrite content is provided and a bottom layer of fluidized material comprises substantially of coal having a higher pyrite content is provided and removing the fluidized material from the fluidized bed, whereby coal having a reduced pyrite content is provided, the improvement thereupon comprised of:

feeding the magnetite free of coal including pyrite into the bed vessel before the coal including pyrite, whereby a bed of a layer of magnetite free of coal including pyrite is formed;

feeding the coal including pyrite and free of magnetite into the bed vessel and on top of the bed of the layer of coal including pyrite and free of magnetite disposed on top of a layer of magnetite free of coal including pyrite is formed;

the bed of magnetite and coal including pyrite, being fluidized until bed-bubbling separation occurs, such that a fluidized bed is formed wherein the solids are stratified in the vertical direction so that a top layer of coal substantially free of pyrite is formed at the very top thereof and with the pyrite being distributed vertically throughout the fluidized bed from the top to the bottom thereof, whereby the fluidized bed has a top layer of fluidized material comprised substantially of coal having a reduced pyrite content is provided; and separating the product coal in the top layer of fluidized material from the refuse coal in the bottom layer of fluidized material, whereby a product including coal having a reduced pyrite content is provided.

2. The process of claim 1, further comprised of:

controlling the rate of the feeding of the magnetite and the rate of the feeding of the coal including pyrite, such that the feed ratio of coal including pyrite to magnetite is controlled and optimized.

3. The process of claim 1, further comprised of:

controlling the rate of the feeding of the magnetite and the feeding of the coal including pyrite, such that the thickness of the bed of magnetite and coal including pyrite is controlled and optimized.

4. The process of claim 1, wherein the fluidizing of the bed of magnetite and coal including pyrite is comprised of gas fluidizing the bed of magnetite and coal including pyrite with fluidizing gases.

5. The process of claim 4, further comprised of the step of:

controlling the length of time of the fluidizing of the bed of magnetite and coal including pyrite based on the thickness of the bed and the superficial velocity of the fluidizing gases.

6. The process of claim 4, wherein the velocity of the fluidizing gases fluidizing the bed of magnetite and coal including pyrite is controlled and optimized.

7. The process of claim 1, wherein said step of separating the top layer of fluidized material from the bottom layer comprise pneumatically suction removing the top layer of fluidized material from the fluidized bed.

8. The process of claim 1, wherein said step of separating the top layer of fluidized material from the bottom layer comprises allowing the bottom layer of particles to flow out of the bed vessel under gravity through openings in the bottom of the bed.

9. The process of claim 1, further comprised of the step of:

magnetically separating the magnetite in the separated top layer of fluidized material from the coal having a reduced pyrite content.

10. The process of claim 1, further comprised the step of:

pulverizing coal including pyrite into a size of 500 microns or smaller before the feeding thereof into the bed vessel.

11. The process of claim 1, further comprised of the step of:

classifying and separating the pulverized coal including pyrite, such that coal including pyrite having a size of 500 microns or smaller is separated from all other coal including pyrite for subsequent feeding of the separated coal into the bed vessel.

12. The process of claim 1, further comprised of the step of:

pulverizing the coal having a reduced pyrite content after fluidization.

13. The process of claim 1, further comprised of the steps of:

pulverizing coal including pyrite before the feeding thereof into the bad vessel; and pulverizing the coal having a reduced pyrite content after fluidization.

14. In an arrangement for the separation of pyrite from coal including pyrite, in a fluidized bed, for providing coal having a reduced pyrite content, the arrangement being of the type having:

a fluidizing bed vessel for receiving therein a material to be fluidized and a fluidizing material;

a magnetite feeder for feeding magnetite into the bed vessel, whereby a bed of a layer of magnetite is formed;

a coal feeder for feeding coal including pyrite into the bed vessel and onto the layer of magnetite, whereby a bed of the material to be fluidized including a layer of coal including pyrite disposed on a layer of magnetite is formed;

means for introducing the fluidizing material into the bed vessel having the bed of the material to be fluidized including the layer of magnetite and the layer of coal including pyrite;

whereby the bed of material to be fluidized including the layer of magnetite and the layer of coal including pyrite is fluidized in the bed vessel, such that the pyrite is substantially separated from the coal, and further such that a fluidized bed is formed, wherein the solids in the fluidized bed are stratified in the vertical direction so that a top layer of coal substantially free of pyrite is formed at the very top thereof and with the pyrite being distributed vertically throughout the fluidized bed from the top to the bottom thereof, such that the fluidized bed has a top layer of fluidized material substantially comprised of coal having a reduced pyrite content and a bottom layer of fluidized material substantially comprised of coal having a higher pyrite content is provided; and means for separating the product coal in the top layer of fluidized material from the refuse coal in the bottom layer of fluidized material, whereby coal having a reduced pyrite content is obtained;

the improvement thereupon comprising:

the fluidizing bed vessel being a bed-bubbling separation fluidizing bed vessel;

the magnetite feeder having means that feeds magnetite free of coal including pyrite into the bed vessel, whereby a bed of a layer of magnetite free of coal including pyrite is formed;

the coal feeder having means that feeds coal including pyrite and free of magnetite into the bed vessel and onto the layer of magnetite free of coal including pyrite; and the means for introducing the fluidized material into the bed vessel provides bed-bubbling separation.

15. The arrangement of claim 14, further comprised of:

a separator for receiving the top layer of fluidized material removed from the fluidized bed and for separating any magnetite in the removed top layer from the coal having the reduced pyrite content, whereby coal having a reduced pyrite content is provided.

16. The arrangement of claim 15, wherein the separator is a magnetic separator.

17. The arrangement of claim 14, wherein the means for introducing a fluidizing material into the bed vessel is comprised of:

a fluidizing gas source;

a conduit between the fluidizing gas source and the bed vessel, whereby the fluidizing gas from the source is carried to the bed of magnetite and coal including pyrite, whereby the bed is gas fluidized until bed-bubbling separation occurs.

18. The arrangement of claim 17, further comprised of:

means for controlling the velocity of the fluidizing gases fluidizing the bed of coal including pyrite and magnetite for optimizing the process.

19. The arrangement of claim 14, further comprised of:

means for controlling the length of the duration of the fluidizing of the bed of magnetite and coal including pyrite on the basis of the thickness of the bed and the superficial gas velocity, whereby the process is optimized.

20. The arrangement of claim 14, wherein the means for separating the product coal in the top layer of fluidized material from the refuse coal in the bottom layer is a pneumatic suction device for removing the top layer of fluidized material from the fluid bed.

21. The arrangement of claim 14, wherein the means for separating the product coal in the top layer of fluidized material from the refuse coal in the bottom layer includes a gravity table having a triangular slot formed therein.

22. The arrangement of claim 14, wherein the means for separating the product coal in the top layer of fluidized material from the refuse coal in the bottom layer includes a plurality of holes for allowing the bottom layer of particles to flow out of the bed vessel under gravity.

23. The arrangement of claim 14, further comprised of:

means for controlling the fluidizing of the bed, such that bed-bubbling separation occurs.

24. The arrangement of claim 14, further comprised of:

means for controlling the feeding of magnetite and the feeding of the coal including pyrite, such that the feed ratio of coal including pyrite to magnetite may be controlled for optimizing the ratio of coal to magnetite in the bed.

25. The arrangement of claim 14, wherein the bed vessel includes a continuously flowing bed of particles.

26. The arrangement of claim 14, further comprised of:

a pulverizer for pulverizing and crushing the coal including pyrite to be fluidized into a size of 500 microns or smaller before the feeding thereof into the bed vessel.

27. The arrangement of claim 26, further comprised of:

a classifier for receiving and classifying the crushed and pulverized coal including pyrite before the feeding thereof into the bed vessel.

* * * * *